US011814714B2

(12) United States Patent
Xu et al.

(10) Patent No.: US 11,814,714 B2
(45) Date of Patent: Nov. 14, 2023

(54) DEVICE FOR REDUCING AND HOMOGENIZING RESIDUAL STRESS OF A METAL FRAME

(71) Applicant: BEIJING INSTITUTE OF TECHNOLOGY, Beijing (CN)

(72) Inventors: Chunguang Xu, Beijing (CN); Wenyuan Song, Beijing (CN); Peilu Li, Beijing (CN); Peng Yin, Beijing (CN); Yuren Lu, Beijing (CN); Shuangyi Li, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 143 days.

(21) Appl. No.: 17/380,090

(22) Filed: Jul. 20, 2021

(65) Prior Publication Data

US 2022/0025500 A1 Jan. 27, 2022

(30) Foreign Application Priority Data

Jul. 23, 2020 (CN) ..... 202010718619.1

(51) Int. Cl.

| | |
|---|---|
| ***C22F 3/00*** | (2006.01) |
| ***B06B 3/00*** | (2006.01) |
| ***C21D 10/00*** | (2006.01) |

(52) U.S. Cl.

CPC ..... *C22F 3/00* (2013.01); *B06B 3/00* (2013.01); *C21D 10/00* (2013.01)

(58) Field of Classification Search

None

See application file for complete search history.

(56) References Cited

U.S. PATENT DOCUMENTS

| | | | | |
|---|---|---|---|---|
| 2020/0370143 | A1* | 11/2020 | Xu | B06B 1/0622 |
| 2022/0025481 | A1* | 1/2022 | Xu | C21D 10/00 |
| 2022/0025500 | A1* | 1/2022 | Xu | C22F 3/00 |

FOREIGN PATENT DOCUMENTS

| | | | |
|---|---|---|---|
| CN | 101912902 | A | 12/2010 |
| CN | 105300578 | A | 2/2016 |
| CN | 206047490 | U | 3/2017 |
| CN | 107253063 | A | 10/2017 |
| CN | 107790897 | A | 3/2018 |
| CN | 108715926 | A | 10/2018 |
| CN | 109371225 | A | 2/2019 |

(Continued)

*Primary Examiner* — Scott R Kastler

(74) *Attorney, Agent, or Firm* — Shumaker, Loop & Kendrick, LLP; John A. Miller

(57) ABSTRACT

A device for reducing and homogenizing residual stress of a metal frame including a substrate, a frame fixing device and ultrasonic vibrators. A groove with an upward opening is provided in the middle of the substrate, and a shape enclosed by vertical side walls of the groove matches a shape of an outer frame of a metal frame to be processed. A plurality of through holes that are horizontally diverged are arranged around the side walls of the groove, and the through holes are vertically intersected with the groove. The ultrasonic vibrators are provided on the substrate and front ends of the ultrasonic vibrators extend into respective through holes to abut against the metal frame in the groove. The frame fixing device is also arranged in the groove where the metal frame is located, after the metal frame to be processed is placed in the groove.

6 Claims, 3 Drawing Sheets

(56) References Cited

FOREIGN PATENT DOCUMENTS

| | | | |
|---|---|---|---|
| CN | 109628729 | A | 4/2019 |
| CN | 110172566 | A | 8/2019 |
| CN | 209537579 | U | 10/2019 |
| DE | 69030928 | | 7/1997 |
| WO | 0010749 | A1 | 3/2000 |

* cited by examiner

DEVICE FOR REDUCING AND HOMOGENIZING RESIDUAL STRESS OF A METAL FRAME

CROSS-REFERENCE TO RELATED APPLICATIONS

This application claims priority to China Patent Application Serial No. 202010718619.1 filed Jul. 23, 2020, the entire disclosure of which is herein incorporated by reference.

BACKGROUND

Field

The present disclosure relates to the field of metal frame processing, and in particular to a device for reducing and homogenizing residual stress of a metal frame.

Discussion of the Related Art

Titanium alloys are widely used in the aerospace field due to their excellent mechanical properties, but they are difficult to be processed due to their small elastic modulus and low thermal conductivity. A non-uniform residual stress field is inevitably introduced into a workpiece after the processes of milling, linear cutting and the like, when a small thin-wall frame component is machined and prepared. The forged titanium alloy blank itself contains residual stress to a certain degree after being prepared. After the residual stress is superposed with a residual stress field generated after processing, the titanium alloy blank causes deformation at the position of the residual stress concentration, which will seriously affect the mechanical property and the fatigue life of a component during the subsequent assembly and service process.

In the prior art, methods for eliminating residual stress include natural aging, stress relief annealing, vibration aging, ultrasonic impact, and the like. The natural aging method is less efficient, takes up a large amount of space for a long time, and has been gradually eliminated. The stress relieving annealing method has strict requirements on the process. If the cooling rate and annealing temperature are not properly treated, additional residual stress will be introduced and the energy consumption will be high. The vibration aging method can effectively eliminate residual stress, but has a limitation in that it cannot be well applied to components with variable cross sections, variable thicknesses and holes, causing large noise in the control field. During the process of reducing the stress, the ultrasonic impact method may cause microcrack damage to the metal surface and cannot control the internal residual stress state, thereby greatly limiting its practical applications.

Therefore, the present disclosure provides a device for reducing and homogenizing residual stress of a component by means of high energy acoustic beams, which aims at reducing and homogenizing residual stress of a metal frame during the process. The device can efficiently homogenize and reduce overlarge residual stress values without damaging the metal frame, and prevent the deformation of the component during the subsequent assembly and service process.

SUMMARY

In view of the above problems, the present disclosure provides a device for reducing and homogenizing residual stress of a metal frame, by which high energy ultrasonic waves are directly injected into the metal frame through a coupling agent to eliminate and homogenize residual stress on the surface, the subsurface, and at different depths of the interior of the metal frame member.

A first aspect of the present disclosure provides a device for reducing and homogenizing residual stress of a metal frame, comprising:

a substrate, a frame fixing device and ultrasonic vibrator; wherein a groove with an upward opening is provided in the middle of the substrate, and a shape enclosed by vertical side walls of the groove matches a shape of an outer frame of a metal frame to be processed;

a plurality of through holes which are horizontally diverged are arranged around the side walls of the groove, and the through holes are vertically intersected with the groove; the ultrasonic vibrators each of which corresponds to one of the through holes are provided on the substrate, and front ends of the ultrasonic vibrators extend respectively into the respective through holes to abut against the metal frame in the groove; and after the metal frame to be processed is placed in the groove, the frame fixing device is also arranged in the groove where the metal frame is located.

From the above, an inner frame of the metal frame is tightened by the frame fixing device, a part not to be controlled of an outer frame of the metal frame is attached to the side walls of the groove of the substrate, and a part to be controlled of the outer frame is tightened by the ultrasonic vibrators, so as to ensure that the metal frame does not undergo large deformation in the process of residual stress elimination and avoid the assembly accuracy to be affected.

From the above, first high energy ultrasonic waves generated by the ultrasonic vibrators are injected into the metal frame after they are coupled by the coupling agent, and second ultrasonic waves having multiple modes and including directional refracted waves, surface waves, etc., are formed on the surface, the subsurface and the inside of the metal frame. The second ultrasonic waves are absorbed only by local interface regions such as vacancies, dislocations, crystal boundaries, etc. inside the metal frame. When the energy provided by the second ultrasonic waves to the internal quality elements of the metal frame is greater than the potential energy stored in the residual stress field, the residual stress inside the metal frame is released to achieve homogenization and elimination of the residual stress.

Furthermore, a plurality of first ultrasonic wave beams are emitted simultaneously in a plurality of directions by the plurality of ultrasonic vibrators, to perform more comprehensive and integral reduction and homogenization of the residual stress of the metal frame. Furthermore, a plurality of second ultrasonic wave beams can be superimposed in energy to increase the energy intensity, so as to achieve a better effect of residual stress reduction and homogenization. The ultrasonic vibrators are especially suitable for solving the problem that the residual stress of a small-sized thin-wall frame component is difficult to be reduced and homogenized in the prior art.

Wherein, the device according to the present disclosure further comprises annular end covers; a plurality of cylindrical branches which are diverged are provided along a horizontal outer edge of the substrate, and respective middle axial portions of the cylindrical branch are communicated with the through holes in one-to-one correspondence, and outer end portions of the cylindrical branches are fitted with the annular end covers.

Furthermore, middle parts of the ultrasonic vibrators are provided circumferentially with fixing flanges that are fixed to the end covers by screws, and threaded rods of the screws are sleeved with compression springs between their nuts and the fixing flanges.

From the above, the compression springs enable the ultrasonic vibrators to move horizontally and axially by means of spring deformation. When the metal frame is deformed to a small extent due to residual stress release, the front ends of the ultrasonic vibrators are ensured to be automatically in close contact with the outer frame of the metal frame by means of automatic deformation of the compression springs, thus avoiding damage to the metal frame and surfaces of the front ends of the ultrasonic vibrators due to longtime direct tightening.

The ultrasonic vibrators each include an ultrasonic transducer and an ultrasonic horn that is located at a front portion of the corresponding ultrasonic vibrator and is coated with a coupling agent on its front end.

From the above, the ultrasonic transducer generates ultrasonic waves whose amplitude is amplified by the ultrasonic horns to achieve energy aggregation, and the region to be controlled of the metal frame can be aligned more accurately. The type of the ultrasonic horns is selected to match material properties of the metal frame, in accordance with an acoustic velocity of the metal frame. A coupling agent is applied to the front end of the ultrasonic horns to assist in ultrasonic waves to be coupled and injected into the metal frame.

Wherein, front ends of the ultrasonic vibrators are provided with ultrasonic tool heads to match an area of portions of the metal frame where residual stress exists.

From the above, the end faces of the ultrasonic horns each have a radius of between 20 and 80 mm, and are provided with ultrasonic tool heads whose area is equivalent to the area of the regions to be controlled, so as to ensure full elimination of the residual stress in the regions to be controlled and improve the elimination efficiency.

Wherein, the device according to the present disclosure further comprises a multiplex controller which is connected with the ultrasonic vibrators by an electric wire to control working parameters of ultrasonic waves of the ultrasonic vibrators.

From the above, the multiplex controller can control the working parameters of each of the ultrasonic vibrators including at least one of a frequency, an amplitude, a phase and an injection duration in a single round. The working frequency of the ultrasonic waves is set in accordance with the material of the metal frame; the amplitude of the ultrasonic waves is set in accordance with a magnitude of the residual stress of the region to be controlled of the metal frame, so as to ensure the control effect without damaging the metal frame; ultrasonic waves in all directions are controlled in terms of the phase to achieve energy superposition when being aligned to the same controlled region, so as to improve the effect of residual stress reduction and homogenization; and the injection duration in a single round needs to be controlled to avoid damage to the metal frame due to longtime injection.

Wherein, the frame fixing device comprises a plurality of inner tightening blocks and a single screw tightening device, wherein the screw tightening device has in a horizontal direction a plurality of extension branches each of which presses against one of the internal tightening blocks, and is equipped with a screw at its upper portion to adjust outward extension lengths of the branches.

From the above, the number of the inner tightening blocks is selected in accordance with the shape of the inner frame of the metal frame, the screw on the screw tightening device is rotated to extend the branches in the horizontal direction, and the inner tightening blocks are tightened so as to abut against the inner frame of the metal frame.

Wherein, a lower portion of the substrate is further provided with a fixing portion which is fixed to a machine table.

From the above, the fixing portion fixes the whole device on the machine table for processing the metal frame, so as to achieve in-situ reduction and homogenization of residual stress. Generally, the metal frame is subjected to a plurality of processing procedures, and the residual stress can be reduced and homogenized in time after each procedure is completed. The reduction and homogenization of the residual stress can also be independently performed off-situ after all of the procedures are completed.

Noise reduction devices are also provided around the substrate.

From the above, the noise reduction devices are provided on the periphery of the substrate to isolate the noise from the high energy ultrasonic transducer, so as to ensure that the environmental requirements for noise reduction are met.

In summary, the present disclosure fixes the inner and outer frames of the controlled frame by means of the frame fixing device, the side walls of the groove of the substrate and the front end of the ultrasonic vibrator, injects high energy ultrasound waves in at least one direction into the metal frame by at least one ultrasonic vibrator and forms a high energy focusing zone on the surface, the sub-surface or the inside, etc. of the metal frame, so as to achieve efficient and non-destructive rapid reduction and homogenization of the residual stress of the metal frame.

A second aspect of the present disclosure provides a method for reducing and homogenizing residual stress of a metal frame, comprising:

selecting a type of an ultrasonic horn based on a material of a metal frame;

determining a scheme for residual stress reduction and homogenization based on residual stress distribution of the metal frame, wherein the scheme comprises: the number of ultrasound wave beams to be injected and directions of the beams, whether to add a tool head to the ultrasonic horn, and working parameters of each the ultrasound wave beams; wherein the working parameters comprise at least one of a frequency, an amplitude, a phase and an injection duration in a single round;

fixing the metal frame in the device for reducing and homogenizing residual stress of a metal frame according to the first aspect of the present disclosure; and injecting at least one ultrasonic wave beam into the metal frame based on the determined scheme for residual stress reduction and homogenization, to perform reduction and homogenization of the residual stress of the metal frame for multiple rounds until the residual stress meets requirements;

wherein the residual stress distribution of the metal frame is retested before the reduction and homogenization is performed in each round.

REFERENCE NUMERALS ARE AS FOLLOWS

1—a substrate, 2—an ultrasonic vibrator, 3—a frame fixing device, 4—an end cover, 5—a metal frame, 201—an ultrasonic transducer, 202—an ultrasonic horn, 203—a fixing flange, 301—an internal tightening block, 302—a screw tightening device, 3021—a screw, 3022—a branch, 3023—a liquid, 401—a screw, and 402—compression spring.

DETAILED DESCRIPTION OF THE EMBODIMENTS

The present disclosure provides a device for reducing and homogenizing residual stress of a metal frame.

The device in accordance with an embodiment of the disclosure will now be described in detail with reference to the examples shown in the accompanying drawings.

Figure 1:
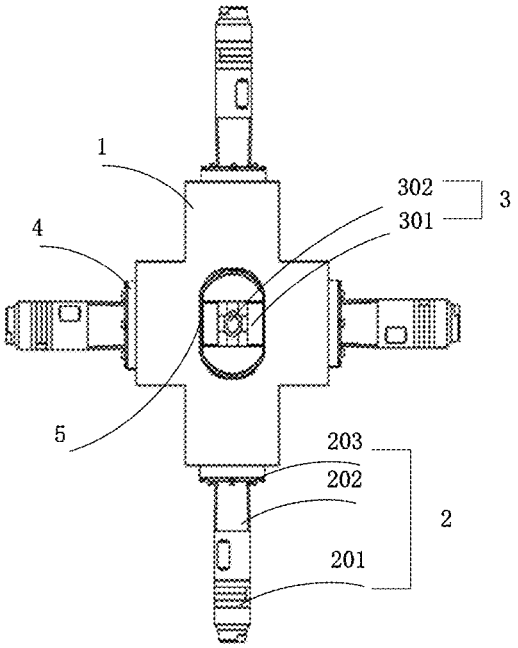
FIG. 1 is a top view of a device according to an embodiment of the present disclosure.
Figure 2:
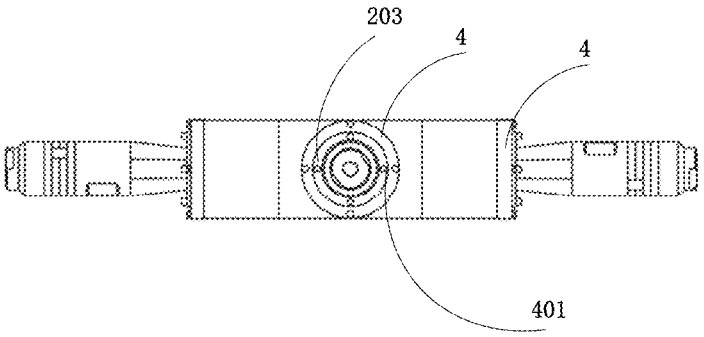
FIG. 2 is a left side view of the device according to an embodiment of the present disclosure.
Figure 3:
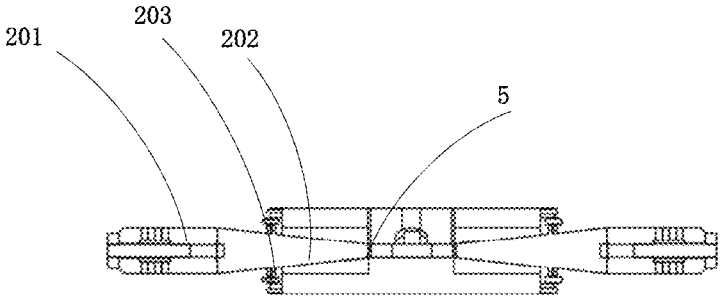
FIG. 3 is a cross-sectional view of the device according to an embodiment of the present disclosure.

As shown in FIG. 1, FIG. 2 and FIG. 3, the present disclosure provides a device for reducing and homogenizing residual stress of a metal frame, which includes a substrate 1, a frame fixing device 3 and an ultrasonic vibrator 2.

A groove with an upward opening is provided in the middle of the substrate 1, and the shape enclosed by vertical side walls of the groove matches the shape of an outer frame of a metal frame 5 to be processed so as to accommodate the metal frame to be processed. A plurality of through holes which are horizontally diverged are arranged around the side walls of the groove, and each through hole is vertically intersected with the groove. A plurality of ultrasonic vibrators 2 each of which corresponds to one of the through holes are provided on the substrate, and front ends of the ultrasonic vibrators 2 (i.e., the working end of the ultrasonic horn 202) extend respectively into the respective through holes to abut against the metal frame 5 in the groove. After the metal frame 5 to be processed is placed in the groove, the frame fixing device 3 is also placed in the groove where the metal frame 5 is located, and the frame fixing device 3 is tightly attached to an inner frame of the metal frame 5 to be processed, so that the metal frame 5 is stably fixed for stress treatment by the ultrasonic vibrators 2.

Figure 4:
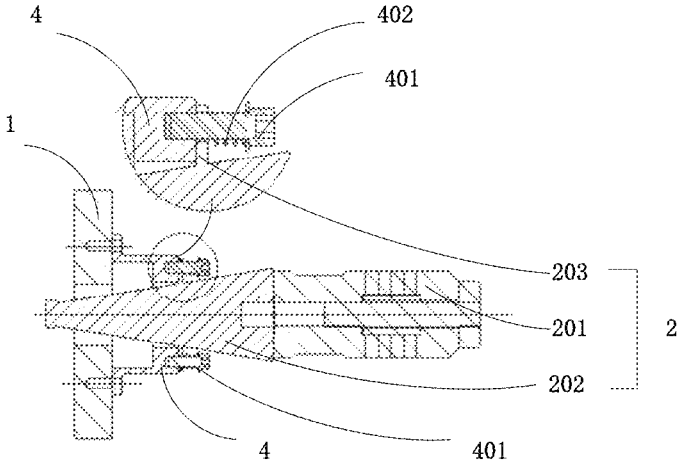
FIG. 4 is a schematic structural diagram of a fixing flange of an ultrasonic vibrator according to an embodiment of the present disclosure, the fixing flange being fixed to an end cover.

Furthermore, the substrate 1 can be formed by a plurality of cylindrical branches which are horizontally diverged, and the groove with an upward opening is provided in the middle of the substrate 1. Each cylindrical branch is axially provided with a through hole which is communicated with the groove, and the columnar branches are provided with annular end covers 4 at their outer end portions. Each end cover 4 is provided with one of the ultrasonic vibrators 2, and each ultrasonic vibrator 2 is provided with a fixing flange 203 at its middle part which is fixed on the corresponding end cover 4 through screws 401. In FIG. 4, a threaded rod of each of the screws 401 is sleeved with a compression spring 402 between its nut and the fixing flange 203 of the corresponding ultrasonic vibrator, in order to adapt to possible deformation of the metal frame 5 during the control.

The lower part of the substrate 1 is also provided with a fixing part which is fixed with a machine table, and noise reduction devices are arranged around the substrate 1. As shown in FIG. 1, the substrate 1 of the present embodiment has four columns forming a square cross shape. The material of the substrate 1 can be ferrous metal or nonferrous metal with higher hardness, but it must to be performed stress relief treatment to ensure that the substrate 1 has enough lightness to avoid deformation of the substrate 1 during the process of eliminating residual stress.

Figure 5:
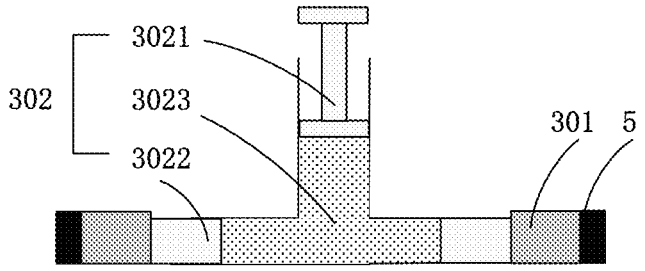
FIG. 5 is a schematic structural diagram of a screw tightening device of the frame fixing device according to an embodiment of the present disclosure.

The frame fixing device 3 includes a plurality of internal tightening blocks 301 and a single screw tightening device 302. FIG. 5 is a schematic structural diagram of each of the screw tightening devices 302, which has a plurality of extension branches 3022 in the horizontal direction. Each branch 3022 presses against the internal tightening blocks 301, and the screw tightening device 302 is equipped with a screw 3021 at its upper portion. The screw 3021 is rotated clockwise to push liquid 3023 downwards, so that the branches 3022 are driven through the liquid 3023 to move outward to push the internal tightening blocks 301 against the inner frame of the metal frame 5.

The ultrasonic vibrators 2 each include an ultrasonic transducer 201 and an ultrasonic horn 202. The ultrasonic transducer 201, which simultaneously transmits transverse and longitudinal waves, is connected with a multiplex controller by an electric wire, and effective waterproof treatment is performed simultaneously to prevent short circuit of electric appliances and corrosion of the ultrasonic transducer 201 by cooling liquid or cutting liquid of a machine tool during in-situ analysis. The ultrasonic horn 202 which is positioned at the front of the ultrasonic vibrator is coated with an ultrasonic coupling agent on its front end. An ultrasonic tool head can be also provided on the front end of the ultrasonic horn 202, so as to match the size of a region to be controlled of the metal frame 5.

The multiplex controller may control the working parameters of each of the ultrasonic vibrators 2 including at least one of a frequency, an amplitude, a phase, and an injection duration in a single round. Usually, the ultrasonic frequency is 5 KHz-50 KHz, the output power is 10-400 W, and the injection duration in a single round is 20-40 min.

The working principle of the device for reducing and homogenizing residual stress of a metal frame is described below.

The inner frame of the metal frame 5 is tightened by the frame fixing device 3, and the outer frame is tightened by the front ends of the ultrasonic vibrators 2, so as to ensure that the metal frame 5 does not undergo large deformation in the process of residual stress elimination and avoid the assembly accuracy to be affected.

First high energy ultrasonic waves generated by the ultrasonic vibrators 2 are injected into the metal frame 5 after they are coupled by the coupling agent, and second ultrasonic waves having multiple modes and including directional refracted waves, surface waves, guided waves, etc., are formed on the surface, the subsurface and the inside of the metal frame 5. The second ultrasonic waves are absorbed only by local interface regions such as vacancies, dislocations, crystal boundaries, etc. inside the metal frame 5. When the energy provided by the second ultrasonic waves to the internal quality elements of the metal frame 5 is greater than the potential energy stored in the residual stress field, the residual stress inside the metal frame 5 is released to achieve the homogenization and elimination of the residual stress.

Furthermore, a plurality of first ultrasonic wave beams are simultaneously emitted in a plurality of directions by the plurality of ultrasonic vibrators 2, to perform more comprehensive and integral reduction and homogenization of residual stress of the metal frame 5. Furthermore, a plurality of second ultrasonic wave beams can be superimposed in energy to increase the energy intensity, so as to improve the effect of transient reduction and homogenization of the residual stress. The energy required for the transient reduction and homogenization of residual stress is much lower than the energy for stress relief annealing. After the high energy ultrasonic waves are removed, the metal frame 5 restores its original material properties without reducing its strength. The method in the present embodiment is thus an efficient and non-destructive method for reducing and homogenizing residual stress, which is especially suitable for solving the problem that the residual stress of a small-sized thin-wall frame component is difficult to be reduced and homogenized in the prior art.

The advantages of the device for reducing and homogenizing residual stress of a metal frame are described below.

The threaded rods of the screws 401 for fixing the ultrasonic vibrators 2 on the end covers 4 are sleeved with the compression springs 402 between their nuts and the fixing flanges 203 of the ultrasonic vibrators. The compression springs 402 enable the ultrasonic vibrators 2 to move horizontally and axially by means of spring deformation. When the metal frame 5 is deformed to a small extent due to residual stress release, the front ends of the ultrasonic vibrators 2 are ensured to be automatically in close contact with the outer frame of the metal frame 5 by means of automatic deformation of the compression springs 402, thus avoiding damage to the metal frame 5 and surfaces of the front ends of the ultrasonic vibrators 2 due to longtime direct tightening.

The ultrasonic horns 202 of the ultrasonic vibrators 2 amplify amplitudes of the ultrasonic waves to achieve energy aggregation, so the region to be controlled of the metal frame 5 can be aligned more accurately. The type of the ultrasonic horns 202 is selected to match material properties of the metal frame 5, in accordance with an acoustic velocity of the metal frame 5. The front ends of the ultrasonic vibrators 2 each have a radius of between 20 and 80 mm and are each also provided with an ultrasonic tool head to match an area of portions of the metal frame 5 where residual stress exists.

The front ends of the ultrasonic vibrators 2 are coated with an ultrasonic coupling agent to directly contact the outer frame of the metal frame 5, so as to improve the efficiency of ultrasonic waves coupling and injection and the effect of residual stress reduction and homogenization.

Wherein, the multiplex controller can control the working parameters of each of the ultrasonic vibrators 2 including at least one of a frequency, an amplitude, a phase and an injection duration in a single round. The multiplex controller can control the ultrasonic working frequencies of the ultrasonic vibrators 2 in accordance with the material of the metal frame 5; control the ultrasonic amplitudes in accordance with a magnitude of the residual stress of the region to be controlled of the metal frame 5, so as to ensure the control effect without damaging the metal frame 5; control an emission time of each of the ultrasonic vibrators 2 in each direction in time sequence to improve the energy efficiency; control ultrasonic waves in all directions in terms of the phase to be aligned to the same controlled region to achieve energy superposition, so as to improve the effect of residual stress reduction and homogenization; control an emission time of the ultrasonic vibrators 2 in each direction according to the injection duration in a single round, so as to improve the energy efficiency and avoid damage to the metal frame 5 by longtime ultrasonic injection.

Wherein, the frame fixing device 3 comprises the plurality of internal tightening blocks 301 and the single screw tightening device 302. The number of the internal tightening blocks 301 is selected in accordance with the shape of the inner frame of the metal frame 5, so as to adapt to various shapes of the metal frame 5.

Wherein, the lower part of the substrate 1 is also provided with the fixing portion to fix the whole device on a machine table for processing the metal frame 5, so as to achieve in-situ reduction and homogenization of residual stresses. Generally, the metal frame 5 is subjected to a plurality of processing procedures, and the residual stress can be reduced and homogenized in time after each procedure is completed. The reduction and homogenization of the residual stress can also be independently performed off-situ after all of the procedures are completed.

The noise reduction devices are also provided around the substrate 1 to isolate the noise from the high energy ultrasound transducers 201, so as to ensure that the environmental requirements for noise reduction are met.

A method for reducing and homogenizing residual stress of a metal frame is described below, which comprises steps S110-S170.

In the step S110, a type of the ultrasonic horn 202 is selected in accordance with an acoustic velocity of a material of the metal frame 5.

In the step S120, residual stress of the metal frame 5 is tested on an external equipment.

In the step S130, a scheme for residual stress reduction and homogenization is determined in accordance with distribution and magnitude of the residual stress of the metal frame 5, wherein the scheme comprises: the number of ultrasound wave beams to be injected and directions of the beams, whether to add the tool heads to the ultrasonic horn 202, and working parameters of the ultrasonic wave beams; wherein the working parameters comprise at least one of the frequency, the amplitude, the phase and the injection duration in a single round.

In the step S140, the metal frame 5 is fixed in the device for reducing and homogenizing residual stress of a metal frame.

In the step S150, based on the scheme for residual stress reduction and homogenization determined in the step S130, a frequency, an amplitude and a phase of each of the ultrasonic vibrators 2 in each direction are set by the multiplex controller, and the ultrasonic transducers 201 are turned on to perform residual stress reduction and homogenization of the metal frame 5 in one round in accordance with the injection duration in a single round. Generally, the frequency of the ultrasonic waves is 5 KHz-50 KHz, the output power of the ultrasonic waves is 200-400 W, and the injection time of the high energy ultrasonic waves in a single round is 20-40 min.

In the step S160, the residual stress of the metal frame 5 is detected on the external equipment.

Figure 6:
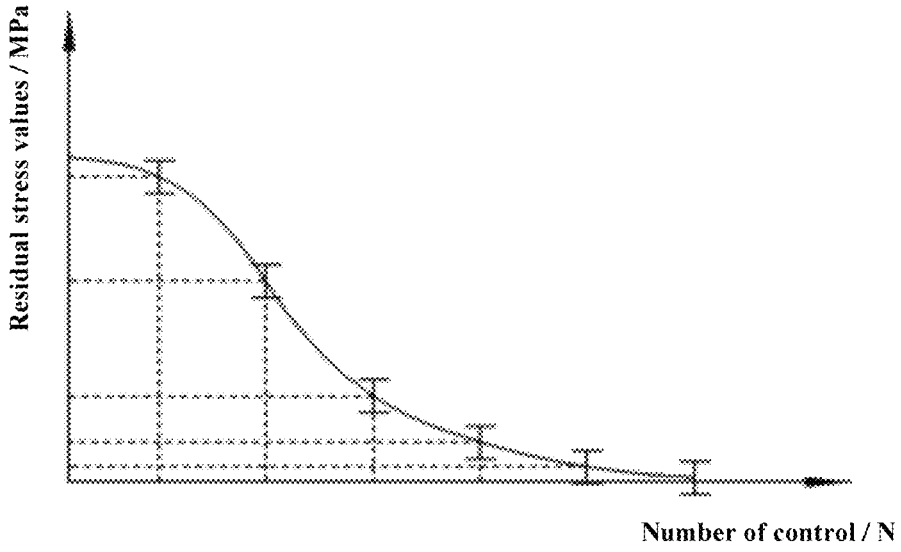
FIG. 6 is a schematic diagram showing the effect of the residual stress reduction and homogenization.

In the step S170, it is determined whether the residual stress of the metal frame 5 satisfies a requirement. If the requirement is satisfied, the process of reducing and homogenizing the residual stress of the metal frame 5 is completed. If the requirement is not satisfied, then the steps S130 to S160 are repeated until the residual stress of the metal frame 5 satisfies the requirement. FIG. 6 is a graph of the change of the residual stress of the metal frame 5 during multiple rounds of control.

The above descriptions are only used to explain the preferred embodiments of the present disclosure and are not intended to limit the present disclosure. Any modification, equivalent replacement, improvement, etc. made within the spirit and principle of the present disclosure shall be included within the protection scope of the present disclosure.

What is claimed is:

1. A device for reducing and homogenizing residual stress of a metal frame, comprising: a substrate, a frame fixing device, annular end covers and ultrasonic vibrators; wherein, a groove with an upward opening is provided in the middle of the substrate, and a shape enclosed by vertical side walls of the groove matches a shape of an outer frame of the metal frame to be processed;

a plurality of through holes that are arranged around the side walls of the groove and disposed toward different directions in a horizontal plane, and the through holes are vertically intersected with the groove;

the ultrasonic vibrators holes are provided on the substrate and have a one-to-one correspondence with the through holes, and front ends of the ultrasonic vibrators extend respectively into the corresponding through holes to abut against the metal frame in the groove;

a plurality of cylindrical branches that are diverged disposed toward different directions are provided along a horizontal outer edge of the substrate, respective middle axial portions of the cylindrical branches are communicated with the through holes in one-to-one correspondence, and outer end portions of the cylindrical branches are fitted with the annular end covers;

middle parts of the ultrasonic vibrators are provided circumferentially with fixing flanges that are fixed to the end covers by screws, and threaded rods of the screws are sleeved with compression springs between their nuts and the fixing flanges;

the ultrasonic vibrators each include an ultrasonic transducer and an ultrasonic horn that is located at a front portion of the corresponding ultrasonic vibrator and is coated with a coupling agent on its front end; and after the metal frame to be processed is placed in the groove, the frame fixing device is also arranged in the groove where the metal frame is located.

2. The device according to claim 1, wherein front ends of the ultrasonic vibrators are provided with ultrasonic tool heads to match an area of portions of the metal frame where residual stress exists.

3. The device according to claim 1, wherein the frame fixing device comprises a plurality of inner tightening blocks and a single screw tightening device, wherein the screw tightening device has in a horizontal direction a plurality of extension branches each of which presses against one of the internal tightening blocks, and is equipped with a screw at its upper portion to adjust outward extension lengths of the branches.

4. The device according to claim 1, further comprising a multiplex controller that is connected with the ultrasonic vibrators by an electric wire to control working parameters of ultrasonic waves of the ultrasonic vibrators.

5. The device according to claim 1, wherein a lower portion of the substrate is further provided with a fixing portion that is fixed to a machine table.

6. The device according to claim 1, wherein noise reduction devices are further provided around the substrate.

* * * * *